US010777896B2

(12) United States Patent
Anguera Pros et al.

(10) Patent No.: US 10,777,896 B2
(45) Date of Patent: Sep. 15, 2020

(54) COUPLED ANTENNA SYSTEM FOR MULTIBAND OPERATION

(71) Applicant: Fractus Antennas, S.L., Sant Cugat del Vallès, Barcelona (ES)

(72) Inventors: Jaume Anguera Pros, Vinaros (ES); Aurora Andujar Linares, Barcelona (ES)

(73) Assignee: Fractus Antennas, S.L., Sant Cugat del Vallès, Barcelona (ES)

( * ) Notice: Subject to any disclaimer, the term of this patent is extended or adjusted under 35 U.S.C. 154(b) by 74 days.

(21) Appl. No.: 16/232,749

(22) Filed: Dec. 26, 2018

(65) Prior Publication Data

US 2019/0221936 A1 Jul. 18, 2019

Related U.S. Application Data

(63) Continuation of application No. 14/878,520, filed on Oct. 8, 2015, now Pat. No. 10,199,730.
(Continued)

(30) Foreign Application Priority Data

Oct. 16, 2014 (EP) ..... 14189253
Oct. 30, 2014 (EP) ..... 14191145
(Continued)

(51) Int. Cl.
*H01Q 9/04* (2006.01)
*H01Q 5/328* (2015.01)
*H01Q 1/48* (2006.01)

(52) U.S. Cl.
CPC ..... *H01Q 9/0442* (2013.01); *H01Q 1/48* (2013.01); *H01Q 5/328* (2015.01)

(58) Field of Classification Search
CPC .. H01Q 9/0407; H01Q 9/0414; H01Q 9/0421; H01Q 9/0442; H01Q 9/045
See application file for complete search history.

(56) References Cited

U.S. PATENT DOCUMENTS 6,674,411 B2 1/2004 Boyle
7,148,850 B2 12/2006 Puente Baliarda et al.
(Continued)

FOREIGN PATENT DOCUMENTS

JP 2002223114 8/2002
JP 2006279159 10/2006
(Continued)

OTHER PUBLICATIONS

Chen, Z.N., and K.M. Luk, (Eds), "Antennas for Base Stations: In Wireless Communications," New York: McGraw-Hill, 2009.
(Continued)

*Primary Examiner* — Daniel Munoz
(74) *Attorney, Agent, or Firm* — Edell, Shapiro & Finnan, LLC

(57) ABSTRACT

A radiating system configured to operate electromagnetic wave signals from first and second frequency regions, wherein the lowest frequency of the second frequency region is above the highest frequency of the first frequency region: the radiating system comprising a radiating structure, a radiofrequency system, and an external port. The radiating structure comprises a first boosting element electrically connected to a first conductive element, a second boosting element electrically connected to a second conductive element, and a ground plane layer. The radiofrequency system comprises a first matching network connected to the first conductive element and the external port, and a second matching network connected to the second conductive element and a ground port. The first and second matching networks are configured to modify the impedance of the
(Continued)

radiating structure providing impedance matching to the radiating system, at the external port, in the first and second frequency regions.

15 Claims, 7 Drawing Sheets

Related U.S. Application Data

(60) Provisional application No. 62/159,998, filed on May 12, 2015, provisional application No. 62/064,716, filed on Oct. 16, 2014, provisional application No. 62/072,671, filed on Oct. 30, 2014, provisional application No. 62/152,991, filed on Apr. 27, 2015.

(30) Foreign Application Priority Data

Apr. 27, 2015 (EP) ..... 15165167
May 12, 2015 (EP) ..... 15167298

(56) References Cited

U.S. PATENT DOCUMENTS

| | | | | |
|---|---|---|---|---|
| 7,274,340 | B2 | 9/2007 | Ozden et al. | |
| 7,315,289 | B2 | 1/2008 | Puente Baliarda et al. | |
| 7,397,431 | B2 | 7/2008 | Baliarda et al. | |
| 2010/0109955 | A1* | 5/2010 | Anguera ..... | H01Q 1/48 343/702 |
| 2010/0176999 | A1 | 7/2010 | Anguera et al. | |
| 2014/0015728 | A1 | 1/2014 | Anguera Pros et al. | |
| 2014/0015730 | A1 | 1/2014 | Anguera Pros et al. | |
| 2014/0253395 | A1 | 9/2014 | Puente Baliarda et al. | |

FOREIGN PATENT DOCUMENTS

| | | |
|---|---|---|
| WO | 2007128340 | 11/2007 |
| WO | 2008009391 | 1/2008 |
| WO | 2008119699 | 10/2008 |
| WO | 2010015364 | 2/2010 |
| WO | 2010015365 | 2/2010 |
| WO | 2014012796 | 1/2014 |
| WO | 2014012842 | 1/2014 |

OTHER PUBLICATIONS

Gianvittprio, J.P., "Fractals, MEMS, and FSS Electromagnetic Devices: Miniaturization and Multiple Resonances," PhD Thesis, University of California, Los Angeles, 2003.

Jung, J. H. et al, Design and performance of small electromagnetically coupled monopole antenna for broadband operation, IET Microwave Antennas Propagation, vol. 1, No. 2, pp. 536-541, Apr. 2007.

Nakano , H. et al, Realization of dual frequency and wide band vswr performances using normal mode helical and inverted-F antennas, Antennas and Propagation, IEEE Transactions on, vol. 46, No. 6, Jun. 1998.

Risco, S. et al, Coupled monopole antenna design for multiband handset devices, Microwave and Optical Technology Letters, vol. 52, No. 2, Feb. 2010.

Risco, S. ; Anguera , J. , Coupled monopole antenna techniques for handset devices, Fractus / Universitat Ramon Llull—La Salle, May 2008.

Risco, S., Coupled monopole antenna techniques for handset devices, Universitat Ramon Llull (URL)—La Salle / Fractus (final degree project), Feb. 2008.

Risco, S. et al, Comparison of a monopole and a PIFA handset antenna in the presence of the human head, Microwave and Optical Technology Letters, vol. 54, No. 2, Feb. 2012.

Taylor, C. D. et al, Theory of coupled monopoles, IEEE Transactions on Antennas and Propagation, vol. AP-18, No. 3, May 1970.

Balanis, C.A., Antenna Theory: Analysis and design, New York: John Wiley & Sons, 1997, pp. 513-516, 528-531.

Gianvittorio, J.P., Fractals, MEMS, and FSS Electromagnetic Devices: Miniaturization and Multiple Resonances, PhD Thesis, University of California, Los Angeles, 2003.

Stutzman, W. L.; Thiele G. A., Antenna theory and design, 2nd edition, New York, John Wiley & Sons, pp. 121-125 (1998).

Pozar D. M.; Schaubert D. H., Microstrip antennas: the analysis and design of microstrip antennas and arrays, New York, Institute of Electrical and Electronics Engineers, pp. 62, 66 Fig. 15, 160, 180, 185 (1995).

* cited by examiner

COUPLED ANTENNA SYSTEM FOR MULTIBAND OPERATION

CROSS REFERENCE TO RELATED APPLICATIONS

This application is a continuation of U.S. patent application Ser. No. 14/878,520 filed Oct. 8, 2015, which claims priority under 35 U.S.C. § 119(e) from U.S. Provisional Patent Application Ser. No. 62/159,998, filed May 12, 2015, U.S. Provisional Patent Application Ser. No. 62/064,716, filed Oct. 16, 2014, U.S. Provisional Patent Application Ser. No. 62/072,671, filed Oct. 30, 2014, and U.S. Provisional Patent Application Ser. No. 62/152,991, filed Apr. 27, 2015, the entire contents of which are hereby incorporated by reference. In addition, this application claims foreign priority under 35 U.S.C. § 119(a)-(d) to Application No. EP 15167298.7 filed on May 12, 2015, Application No. EP 14189253.9 filed on Oct. 16, 2014, Application No. EP 14191145.3 filed on Oct. 30, 2014, and Application No. EP 15165167.6 filed on Apr. 27, 2015, the entire contents of which are hereby incorporated by reference.

STATEMENT OF RESEARCH FUNDING

This patent application is part of a project that has received funding from the European Union's Horizon 2020 Research and Innovation Programme under grant agreement No. 674491.

FIELD OF THE INVENTION

The present invention relates to the field of wireless handheld or portable devices, and more generally to electronic devices which require the transmission and/or reception of electromagnetic wave signals.

BACKGROUND

Wireless electronic devices typically handle one or more cellular communication standards, and/or wireless connectivity standards, and/or broadcast standards and, for that purpose, the devices incorporate a radiating system capable of operating in the one or more frequency bands in which said standards are allocated, with an acceptable radioelectric or radiofrequency performance (in terms of, for instance, reflection coefficient, standing wave ratio, impedance bandwidth, gain, efficiency, or radiation pattern).

Besides radiofrequency performance, one of the current limitations of the prior art is that generally the antenna system is customized for every particular wireless handheld or portable device model while requiring features such as small dimensions and reduced interaction with human body and nearby electronic components. The mechanical architecture of each device is different and the volume available for the antenna severely depends on the form factor of the device model together with the arrangement of the multiple components embedded into the device (e.g., displays, keyboards, battery, connectors, cameras, flashes, speakers, chipsets, memory devices, etc.). As a result, the antenna within the device is mostly designed ad hoc for every model, resulting in a higher cost and a delayed time to market. In turn, as typically the design and integration of an antenna element for a radiating structure is customized for each wireless device, different form factors or platforms, or a different distribution of the functional blocks of the device will force to redesign the antenna element and its integration inside the device almost from scratch.

A radiating system for a wireless handheld or portable device typically includes a radiating structure comprising an antenna element which operates in combination with a ground plane layer providing a determined radiofrequency performance in one or more frequency regions of the electromagnetic spectrum. Typically, the antenna element has a dimension close to an integer multiple of a quarter of the wavelength at a frequency of operation of the radiating structure, so that the antenna element is at resonance or substantially close to resonance at the frequency of operation, and a radiation mode is excited on the antenna element. Due to given space limitations in the device and the necessity of providing operation in two or more frequency bands that, in some cases, are located in at least two separate frequency regions of the electromagnetic spectrum, the antenna elements usually present complex mechanical designs and considerable dimensions, mainly due to the fact that antenna performance is highly related to the electrical dimensions of the antenna element. Although the radiating structure is usually very efficient at the resonant frequency of the antenna element maintaining a similar performance within a frequency range defined around said resonant frequency (or resonant frequencies), outside said frequency range the efficiency and other relevant antenna parameters deteriorate with an increasing distance to said resonant frequency.

The integration of the radiating system within the wireless electronic device is also a key aspect in terms of the radioelectric performance (such as for example in terms of radiated power, received power, sensitivity), as once the radiating system is included inside the device, detuning of the radiating system and disruptions due to the electronic components and circuitry embedded in the device deteriorate its performance. Once the design of the electronic device is finished, fine adjustments or tuning of the performance of the antenna are quite limited or even unfeasible. A radiating system as described in the present patent application is intended to provide a solution in this regard, while featuring good radioelectric characteristics such as multiband and/or broadband behavior.

Some techniques for optimizing the broadband or multiband behavior of an antenna element, and/or miniaturizing the antenna element have been described in the prior art.

For example, commonly-owned U.S. Pat. No. 7,148,850 describes a family of antennas based on the geometry of space-filling curves. Also, commonly-owned U.S. Pat. No. 7,397,431 relates to a family of antennas, referred to as multilevel antennas, formed by an electromagnetic grouping of similar geometrical elements.

Another example is commonly-owned U.S. Pat. No. 7,315,289 which describes an antenna comprising at least two arms being coupled to each other through a region on first and second arms such that the combined structure of the coupled two-arms forms a small antenna with a broadband behavior, a multiband behavior or a combination of both effects. In said patent, the multiband response may be obtained by adjusting the length and size of the several-coupled arms, together with the spacing and size of the proximity region defined between the several arms, or by shaping at least one of the arms as a multiband antenna.

Commonly-owned patent applications WO2014/012842 and US2014/0015728 disclose wireless handheld or portable devices including very compact, small size and light weight radiation boosters operating in single or in multiple frequency bands. The entire disclosures of aforesaid application numbers WO2014/012842 and US2014/0015728 are hereby incorporated by reference.

Commonly-owned patent application U.S. 62/028,494 and EP14178369 describe wireless devices including at least one slim radiating system having a slim radiating structure and a radio-frequency system, wherein the slim radiating structure includes one or more booster bars. The entire disclosures of aforesaid application numbers U.S. 62/028,494 and EP14178369 are hereby incorporated by reference.

Commonly-owned patent applications U.S. 62/152,991 and EP15165167 disclose wireless portable or handheld devices with a radiating system configured to transmit and receive electromagnetic wave signals in first and second frequency regions. The radiating system comprises a radiating structure comprising at least one ground plane layer and a radiation booster; a radiofrequency system; and an external port. The radiofrequency system comprises a matching circuit configured to provide impedance matching to the radiating structure, at the external port, in a first frequency region and in a second frequency region. The entire disclosures of aforesaid application numbers U.S. 62/152,991 and EP15165167 are hereby incorporated by reference.

Therefore, a wireless electronic device comprising a radiating system providing broadband or multiband operation without antennas that are geometrically complex or large would be advantageous. It would be also particularly advantageous that the radiating system featured good radioelectric performance with a relatively small ground plane, and that it supports flexibility for tuning and adjusting the performance taking in consideration all the elements included within the device which may detune the radiating system.

SUMMARY

It is an object of the present invention to provide an electronic device (such as for instance but not limited to a mobile phone, a smartphone, a PDA, an MP3 player, a headset, a USB dongle, a GPS system, a digital camera, a wearable device such as a smart watch, a PCMCIA, Cardbus 32 card, a communications module, a sensor, or generally a multifunction wireless device which combines the functionality of multiple devices) comprising a radiating system that covers a wide range of radio frequencies. It is another object of the present invention a portable, handheld, wearable or electrically small wireless device that handles multiple communication bands while exhibiting a suitable radio frequency performance.

Another object of the present invention is to provide a radiating system suitable for being included within electronic devices. Such radiating system is capable of operation in at least a first frequency region and comprises a radiating structure including at least first and second conductive elements and at least one boosting element, a radiofrequency system, and an external port. The at least one boosting element is electrically connected to one of the at least first and second conductive elements, and each of the at least first and second conductive elements are connected to the radiofrequency system. The radiofrequency system comprises at least one matching network and modifies the impedance of the radiating structure providing impedance matching to the radiating system in said at least first frequency region.

In some preferred embodiments, the radiating system is further capable of operation in at least a second frequency region of the electromagnetic spectrum, wherein the at least first and second frequency regions are preferably separated so that the lowest frequency of the second frequency region is above (i.e., at a frequency higher than) the highest frequency of the first frequency region. In such embodiments, the radiofrequency system modifies the impedance of the radiating structure providing impedance matching to the radiating system in the at least first and second frequency regions.

In some embodiments, the radiating structure includes at least first and second boosting elements which may be electrically connected to one of the at least first and second conductive elements; or the at least first boosting element is electrically connected to the at least first conductive element and the at least second boosting element is electrically connected to the at least second conductive element.

The boosting element or elements are configured to be used in radiating systems according to the present invention and are configured to enhance the radioelectric performance of the radiating systems. Said boosting element or elements may take the form and characteristics of radiation boosters disclosed in commonly owned patent applications US2014/0015728 and WO2014/012842, or booster bars disclosed in commonly owned patent applications U.S. 62/028,494 and EP14178369. A boosting element or elements according to the present invention fit in an imaginary sphere having a diameter smaller than ⅓ of a radiansphere corresponding to the lowest frequency of the first frequency region of the radiating system. In some cases, said boosting elements also fit in an imaginary sphere having a diameter smaller than ¼, or preferably smaller than ⅙, or even more preferably smaller than 1/10 of a radiansphere corresponding to said frequency. The radiansphere is defined as an imaginary sphere having a radius equal to the operating wavelength divided by two times π (pi). In some embodiments, the boosting elements may also have a maximum size at least smaller than 1/15 of the free-space wavelength corresponding to the lowest frequency of the first frequency region of the radiating system, and/or smaller than 1/20, and/or smaller than 1/30, and/or smaller than 1/50 of said free-space wavelength. In some of these examples, the boosting elements have a maximum size larger than 1/250, and/or larger than 1/180, and/or larger than 1/120 times the free-space wavelength corresponding to the lowest frequency of the first frequency region of the radiating system.

The maximum size of the boosting element is defined by the largest edge of a bounding box completely enclosing said boosting element, and in which the boosting element is inscribed. More specifically, a bounding box is defined as being the minimum-sized parallelepiped of square or rectangular faces that completely encloses the boosting element and wherein each one of the faces of said minimum-sized parallelepiped is tangent to at least a point of said boosting element. Moreover, each possible pair of faces of said minimum-size parallelepiped sharing an edge forms an inner angle of 90°. For each of the boosting elements included in a radiating structure, a different bounding box is defined. In some examples, one of the dimensions of a bounding box can be significantly smaller than any of the other two dimensions, or even be close to zero and thus practically collapse to a two-dimensional entity.

In some preferred examples, the footprint of a bounding box is advantageously small compared to the square of the wavelength corresponding to the lowest frequency of the first frequency region; in particular, a ratio between said footprint and the square of the wavelength corresponding to the lowest frequency of the first frequency region of operation of the radiating system may be advantageously smaller than at least one of the following percentages: 0.15%, 0.12%, 0.10%, 0.08%, 0.06%, 0.04%, or even 0.02%. In some of these examples, a ratio between the footprint of a bounding box and the square of the wavelength corresponding to the lowest frequency of the second frequency region may also be advantageously smaller than at least one of the following percentages: 0.50%, 0.45%, 0.40%, 0.35%, 0.30%, 0.25%, 0.20%, 0.15%, 0.10%, or even 0.05%.

Moreover, in some embodiments according to the present invention, each one of the at least one boosting element entirely fits inside a limiting volume equal or smaller than $L^3/25000$, and in some cases smaller than $L^3/50000$, and/or $L^3/100000$, and/or $L^3/150000$, and/or $L^3/200000$, and/or $L^3/300000$, and/or $L^3/400000$, and/or even smaller than $L^3/500000$, being L the wavelength corresponding to the lowest frequency of the first frequency region of operation of the radiating system.

It is worth noting that the radioelectric performance the radiating system features is largely conditioned by the size and shape of the ground plane layer that the radiating structure comprises. Although the present invention may feature a good radioelectric performance with relatively large ground planes, a radiating system according to the present invention may achieve substantially good radioelectric performance when the radiating structure comprises a ground plane layer that is small in relation to the free-space wavelength corresponding to the lowest frequency of the first frequency region. Accordingly, in preferred embodiments, the ratio between a long side of the ground plane rectangle defined as the minimum-sized rectangle encompassing a ground plane layer of the radiating structure (i.e. a rectangle whose sides are tangent to at least one point of said ground plane layer), and the free-space wavelength corresponding to the lowest frequency of the first frequency region is greater than 0.1 and smaller than 0.4, in some embodiments even smaller than 0.3, or even smaller than 0.25, and in some more embodiments even smaller than 0.2. A ground plane rectangle is defined as being the minimum-sized rectangle encompassing a ground plane layer of the radiating structure, that is, the ground plane rectangle is a rectangle whose sides are tangent to at least one point of said ground plane layer.

A first preferred embodiment relates to a radiating system configured to operate electromagnetic wave signals from first and second frequency regions, wherein the lowest frequency of the second frequency region is above the highest frequency of the first frequency region: the radiating system comprising a radiating structure, a radiofrequency system, and an external port. The radiating structure comprises a first boosting element electrically connected to a first conductive element, a second boosting element electrically connected to a second conductive element, and a ground plane layer. The radiofrequency system comprises a first matching network connected to the first conductive element and the external port, and a second matching network connected to the second conductive element and a ground port. The first and second matching networks are configured to modify the impedance of the radiating structure providing impedance matching to the radiating system, at the external port, in the first and second frequency regions.

A second preferred embodiment relates to a radiating system configured to operate electromagnetic wave signals from first and second frequency regions, wherein the lowest frequency of the second frequency region is above the highest frequency of the first frequency region: the radiating system comprising a radiating structure, a radiofrequency system, and an external port. The radiating structure comprises at least one boosting element electrically connected to a first conductive element, a second conductive element, and a ground plane layer. The radiofrequency system comprises a first matching network connected to the first conductive element and the external port, and a second matching network connected to the second conductive element and a point in the ground plane. The radiofrequency system is configured to modify the impedance of the radiating structure providing impedance matching to the radiating system, at the external port, in the first and second frequency regions.

In some less preferred embodiments, the radiating system comprises two external ports, and the first matching network comprises a diplexer configured to separate signals of the first frequency region from signals of the second frequency region.

In some of the radiating structures according to the present invention, one of the conductive elements is connected to the ground plane either directly or through a matching network of the radiofrequency system. In the embodiments in which there is a direct connection (with a conductive trace for instance), the radiofrequency system comprises one matching network connected to the other one of the conductive elements and the external port; in other embodiments, the radiofrequency system comprises first and second matching networks, the first one being connected to the first conductive element and the external port, and the second one connected to the second conductive element and the ground plane. The conductive element acting as a parasitic element may be connected to ground by other means and is not limited to the particular connections described herein.

In some embodiments in which the radiating system is configured to operate electromagnetic wave signals from first and second frequency regions, a ratio between the lowest frequency of the second frequency region and the lowest frequency of the first frequency region is greater than 1.5. In some other embodiments, said ratio may be greater than 1.8, or 2.0, or 2.2, or even greater than 2.4. In some of these embodiments, a ratio between the lowest frequency of the second frequency and the highest frequency of the first frequency region may be greater than 1.2, or 1.5, or 1.8, or 2.0, or 2.2, or even greater than 2.4.

Moreover, a radiating system according to the present invention may advantageously feature an impedance bandwidth in the first frequency region greater than any, some or all of the following ratios: 5%, 10%, 15%, and 20%. In addition, such radiating system may also feature an impedance bandwidth in the second frequency region greater than any, some or all of the following ratios: 5%, 10%, 15%, 20%, 25%, and 30%. The impedance bandwidth is defined as the difference between the highest and lowest frequencies of a frequency region, divided by the central frequency of that frequency region.

A boosting element may include a dielectric material, and in some embodiments, a single standard layer of dielectric material spacing two or more conductive elements of the boosting element. A boosting element may be formed by printing or depositing conductive material in a first surface and a second surface of the dielectric material (for instance, two opposed sides such as the top and the bottom ones) and adding several vias to electrically connect the conductive material in the first surface with the conductive material in the second surface. In some preferred examples, the conductive material in each of the first and second surfaces of a boosting element has a substantially polygonal shape. Some possible polygonal shapes are, for instance but not limited to, squares, rectangles, and trapezoids. In some embodiments, a boosting element may be in direct electrical contact with another boosting element or elements.

Another aspect of the present invention is that each of the at least first and second conductive elements is characterized by an electrical length that is less than one fourth of the free-space operating wavelength at the lowest frequency of operation of the radiating system. In some embodiments, such electrical length may be less than one sixth of said free-space operating wavelength, and in some other embodiments, the electrical length of the conductive elements may be less than one eight of the free-space operating wavelength at the lowest frequency of operation of the radiating system.

A further aspect of the present invention is that the first and second conductive elements are arranged in some embodiments such that at least a portion of the first conductive element is adjacent to at least a portion of the second conductive element; or that a first boosting element connected to the first conductive element has at least a portion adjacent to at least a portion of the second boosting element connected to the second conductive element; or that a first conductive element with no boosting element connected to it has at least a portion adjacent to at least a portion boosting element connected to the second conductive element; or that a boosting element connected to the first conductive element has at least a portion adjacent to at least a portion of the second conductive element with no boosting element connected to it.

In the context of the present patent application, two elements are considered to be adjacent when the minimum distance or separation between at least one point in a first element, and at least one point in a second element, in any of the aforementioned cases, is no greater than 3% of the free-space wavelength at the lowest frequency of operation of the radiating system. In preferred embodiments, the minimum distance may be even less 2%, or even less than 1%, or even less than 0.5% of said free-space wavelength.

In preferred examples, the first and second conductive elements of a radiating structure are arranged on a clearance area of a printed circuit board (i.e. area free of ground plane), and the boosting element or elements are attached to (e.g. soldered to or attached by other means as known in the art) said conductive elements. In said preferred examples, each of the first and second conductive elements is a conductive trace in the printed circuit board.

In some embodiments, a radiating structure may comprise more than one ground plane layer, like for instance two, three or even more ground plane layers or conductive materials acting as the ground plane for the radiating structure. In such embodiments, some or all ground plane layers may be electrically interconnected one to each other.

An advantageous aspect of the present invention is that the first and/or second conductive elements may include indentations and/or a series of discrete pads for adjusting the performance of the radiating system in the final stages of development of a device in which it is included, thus streamlining the process of integrating the radiating system within the device and thus reducing the time-to-market.

A radiating system according to the present invention may be configured to transmit and/or receive signals in frequency bands like for example, but not limited to: LTE700 (698-798 MHz), LTE800 (791-862 MHz), GSM850 (824-894 MHz), GSM900 (880-960 MHz), GSM1800 (1710-1880 MHz), GSM1900 (1850-1990 MHz), WCDMA2100 (1920-2170 MHz), CDMA1700 (1710-2155 MHz), LTE2300 (2300-2400 MHz), LTE2600 (2500-2690 MHz), WiFi (2.4-2.5 GHz and/or 4.9-5.9 GHz), etc. Such radiating systems may operate two, three, four, five, six, or even more frequency bands.

In the context of this document, a frequency band preferably refers to a range of frequencies used by a particular cellular communication standard, a wireless connectivity standard or a broadcast standard; while a frequency region preferably refers to a continuum of frequencies of the electromagnetic spectrum. For example, the GSM1800 standard is allocated in a frequency band from 1710 MHz to 1880 MHz while the GSM1900 standard is allocated in a frequency band from 1850 MHz to 1990 MHz. A wireless device operating the GSM1800 and the GSM1900 standards must have a radiating system capable of operating in a frequency region from 1710 MHz to 1990 MHz. As another example, a wireless device operating the GSM850 standard (allocated in a frequency band from 824 MHz to 894 MHz) and the GSM1800 standard must have a radiating system capable of operating in two separate frequency regions.

A radiofrequency system according to the invention comprises at least one matching circuit with one, two, three, four, or more stages each, with each stage comprising one or more circuit components (such as for example, but not limited to, inductors, capacitors, resistors, jumpers, short-circuits, transmission lines, or other reactive or resistive components). A stage can be connected in series or in parallel to other stages and/or to one of the at least one port of the radiofrequency system. In some examples, the matching networks may alternate stages connected in series (i.e., cascaded) with stages connected in parallel (i.e., shunted), forming a ladder structure, or an L-shaped structure (i.e., series-parallel or parallel-series), or a pi-shaped structure (i.e., parallel-series-parallel) or a T-shaped structure (i.e., series-parallel-series). A stage may also substantially behave as a resonant circuit (such as, for instance, a parallel LC resonant circuit or a series LC resonant circuit) in at least one frequency region of operation of the radiating system (such as for instance in the first or second frequency region).

An advantageous aspect of radiofrequency systems as described in the present invention is their efficiency in that impedance matching in the first and second frequency regions may be provided with matching networks comprising reduced numbers of components, which consequently introduces lower losses in the radiofrequency system and makes it more robust against the tolerances of the components.

BRIEF DESCRIPTION OF THE DRAWINGS

Further characteristics and advantages of the invention will become apparent in view of the detailed description which follows of some preferred embodiments of the invention given for purposes of illustration only and in no way meant as a definition of the limits of the invention, made with reference to the accompanying drawings.

DETAILED DESCRIPTION

Figure 1A:
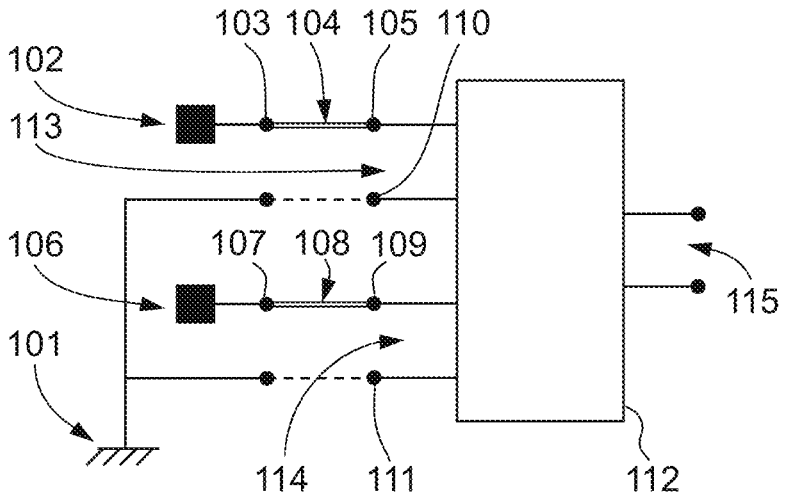
FIG. 1A and FIG. 1B show schematically radiating systems according to the present invention.
Figure 1B:
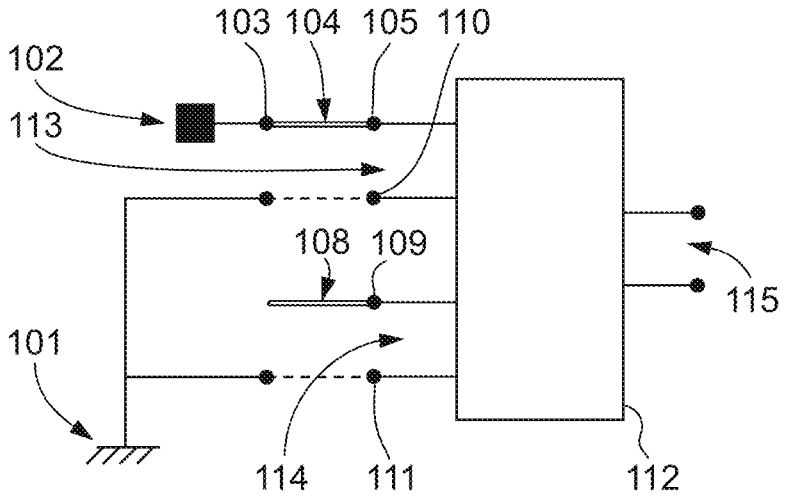

Radiating systems according to the present invention are schematically represented in FIGS. 1A-1B.

In relation to FIG. 1A, the radiating system of a preferred embodiment includes a radiating structure, a radiofrequency system 112, and an external port 115. The radiating structure comprises at least first boosting element 102 electrically connected to conductive element 104 through at least connection point 103, said conductive element 104 includes connection point 105 which, together with first connection point 110 of ground plane layer 101, defines port 113 connected to radiofrequency system 112. The radiating structure further comprises at least second boosting element 106 electrically connected to second conductive element 108 through at least connection point 107. A second port 114 is defined between connection point 109 of the second conductive element and second point 111 of the ground plane layer 101. The radiofrequency system 112 provides impedance matching to the radiating structure at the external port 115 so that the radiating system is configured to operate electromagnetic wave signals in at least a first frequency region, and in some more preferred embodiments, in at least a second frequency region of the electromagnetic spectrum.

The radiating system of FIG. 1B is similar to the one of FIG. 1A, with the difference that there is no second boosting element connected to the second conductive element 108. In some embodiments that resemble to FIG. 1B, the radiating system comprises a second boosting element electrically connected to the same conductive element that the first boosting element is connected to. In such embodiments, preferably the at least first and second boosting elements are arranged one next to the other as shown in FIG. 2B.

Few radiating structures according to the present invention are shown in FIGS. 2A to 2E.

Figure 2A:
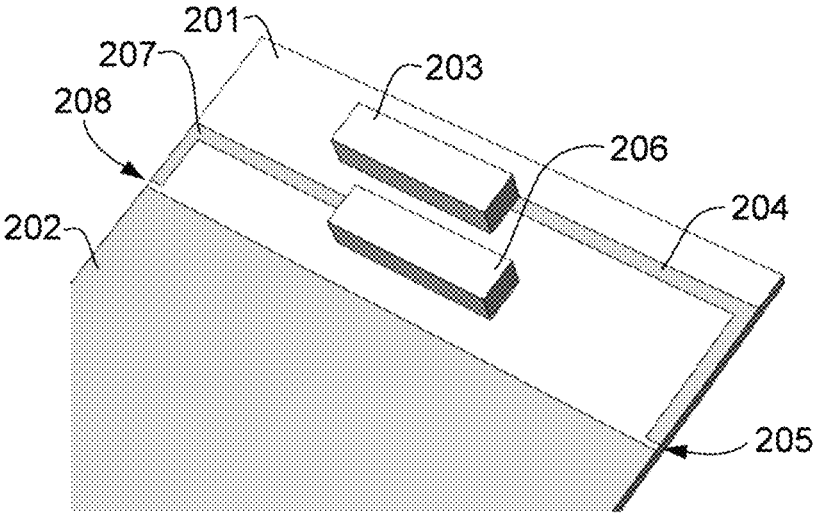
FIGS. 2A to 2E show examples of radiating structures as described in the present invention.

In FIG. 2A, a radiating structure as comprised in the radiating system represented in FIG. 1A is illustrated. The radiating structure comprises first and second boosting elements 206 and 203 connected to first and second conductive elements 207 and 204 respectively. Said conductive elements, in the examples shown in FIGS. 2A-2E, take the form of conductive traces formed on substrate 201. The substrate also comprises ground plane layer 202, which together with respective ends of traces 207 and 204 define ports 208 and 205. The radiofrequency system (as 112 in FIGS. 1A-1B) of the radiating system, not illustrated in FIG. 2A, is connected to said ports 208 and 205. Preferably, the conductive trace which has a majority of its surface closer to the ground plane, in this example trace 207, acts as the driven element and the other one, in this example conductive trace 204, acts as the parasitic element.

Figure 2B:
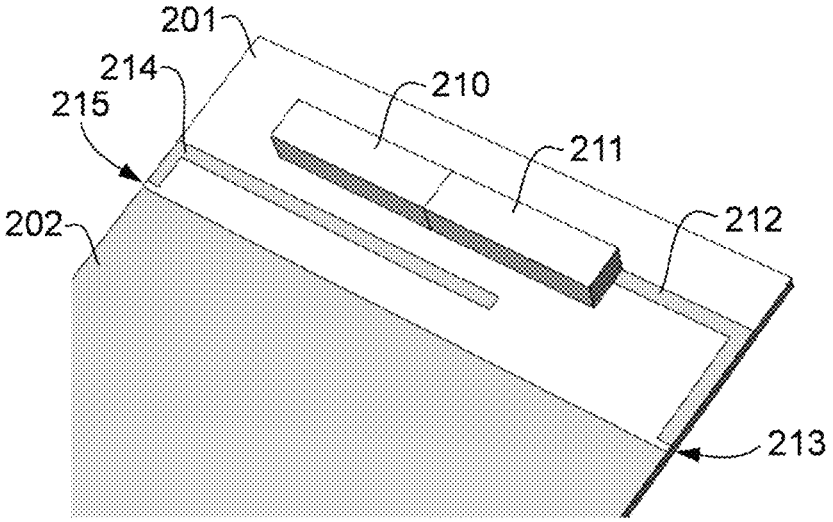

FIG. 2B illustrates a radiating structure according to the scheme of FIG. 1B. In this example, conductive trace 212 has defined port 213 and has connected first and second boosting elements 210 and 211, although in some other examples there may be one boosting element or more than two boosting elements for instance. The conductive trace 214 has no boosting elements connected to it, and defines port 215 for the connection to a radiofrequency system. Preferably, conductive element 214 acts as the driven element and conductive element 212 acts as the parasitic element.

Figure 2C:
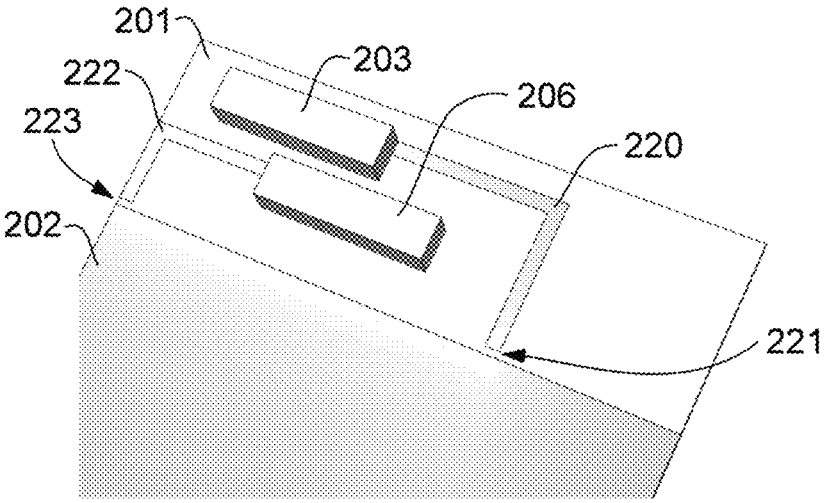

The embodiment of FIG. 2C is similar to FIG. 2A. Boosting elements 203 and 206 are in different relative position with respect to the other boosting element (i.e. separation and lateral alignment); with respect to the position on substrate 201; and with respect to the ground plane layer 202. Further, conductive element or trace 220 has its end defining port 221 not close to a corner of ground plane layer 202. Conductive trace 222 has its end defining port 223 substantially close or proximate to one corner of ground plane layer 202. These variations provide flexibility for allocating the radiating system as the clearance area on which the radiating structure is to be arranged may be smaller so as to allocate circuitry or electronics in different parts of substrate 201. Preferably, conductive trace 222 acts as the driven element and conductive trace 220 acts as the parasitic element.

Figure 2D:
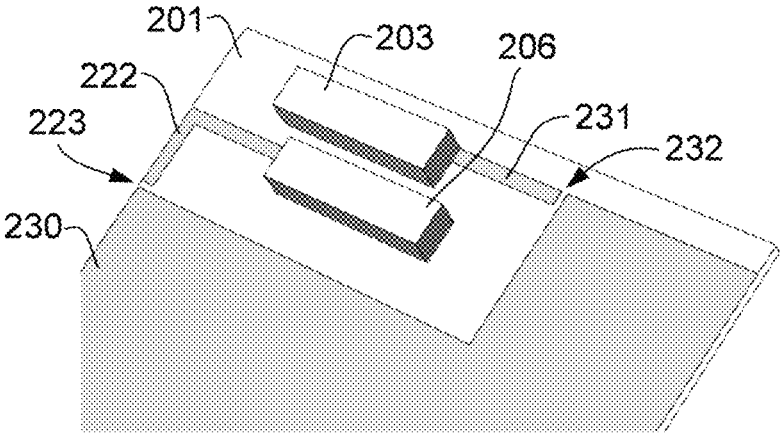

FIG. 2D shows an alternative embodiment in the fashion of FIGS. 2A and 2C wherein the radiating structure comprises a differently-shaped ground plane layer 230, and thus conductive element 231 defining port 232 has a straight-line shape, instead of an L shape. It is clear to the skilled in the art that the conductive elements as disclosed herein may feature different shapes as long as: portions of first and second conductive elements 231 and 222 are adjacent to each other; or the first boosting element 203 has a portion adjacent to second boosting element 206; or in the case of FIG. 2B, conductive element 214 has a portion adjacent to boosting elements 210 or 211 (or both). Further, each of the shapes of the conductive traces are such that the electrical length of each conductive trace is less than one fourth of the free-space wavelength corresponding to the lowest frequency of operation of the radiating system.

Figure 2E:
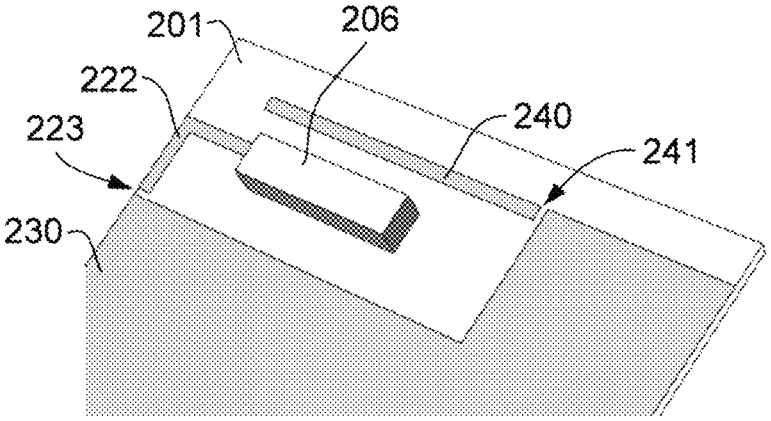

In FIG. 2E the radiating system comprises first boosting element 206 connected to first conductive trace 222, and second conductive trace 240 with a portion adjacent to first conductive element has no boosting elements connected to it. The second conductive element has a port 241 defined towards a connection point in ground plane layer 230.

The adjacent portions in the arrangements of conductive elements and/or boosting elements of FIGS. 2A-2E may enhance the overall radioelectric performance of the radiating systems due to the interaction between the driven and parasitic elements of the radiating structures.

The particular ground plane layers 202 and 230 have shapes and dimensions such that associated ground plane rectangles feature a ratio between the length of a longest side of said ground plane rectangles and the free-space wavelength corresponding to the lowest frequency of the first frequency region greater than 0.1 and smaller than 0.2, although in other embodiments said ratio may be comprised between 0.1 and 0.4.

A possible mechanism for adjusting the performance of a radiating system as disclosed herein is illustrated in FIGS. 3A-3D.

Figure 3A:
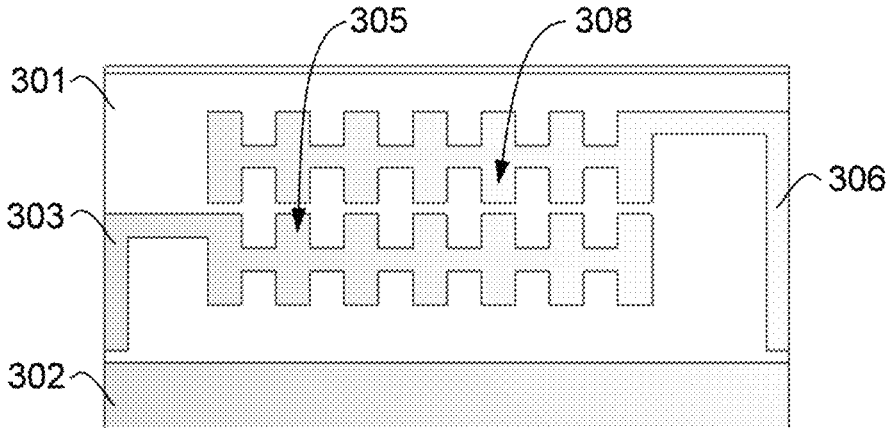
FIG. 3A-3D show examples of a radiating system including conductive elements configured to finely tune the performance of the radiating system.

In FIG. 3A, substrate 301 comprises ground plane layer 302, first conductive trace 303 with indentations 305, and second conductive trace 306 with indentations 308.

Figure 3B:
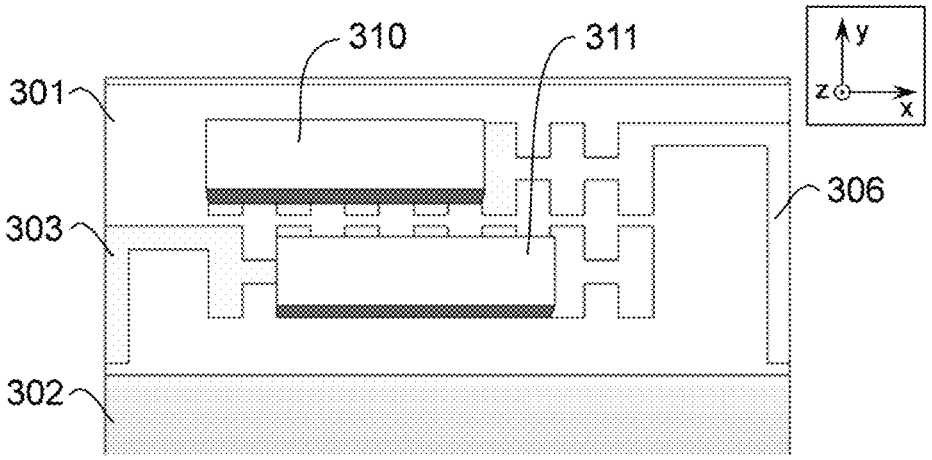
Figure 3C:
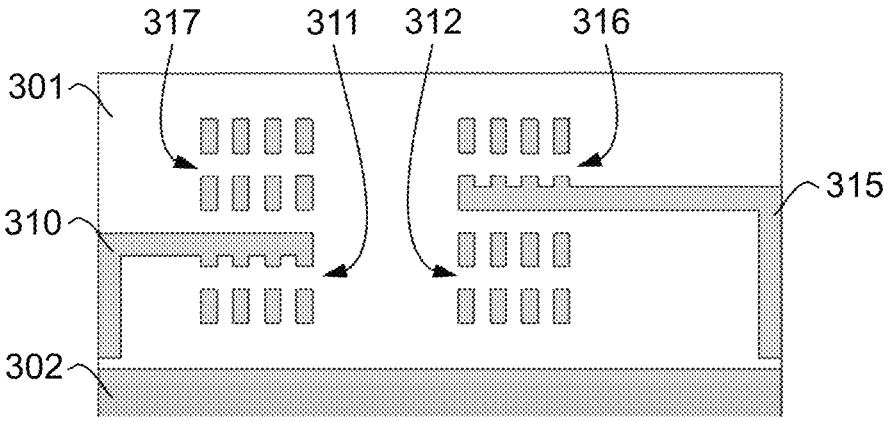

Indentations 305 and 308 support variable placements of boosting elements 310 and 311 as shown in FIG. 3B. Thus the boosting elements may be connected to conductive traces 303 and 306 at different positions in the X and Y axes in relation to the set of coordinates included, for illustrative purposes, in the top-right corner of FIG. 3B. Modifying the position in one axis, or in both axes, and thus alter the adjacency between the boosting elements is simple and convenient even after the design of the device is completely finished, and all the electronics and components are included regardless if they are put directly on substrate 301 or in the frame or case of the device (e.g. RF modules, amplifiers, battery, cameras, loudspeakers, etc). With adjustments of the position of the boosting elements, the overall radioelectric performance may be enhanced.

It is clear to the skilled in the art that other implementations enabling the shifting in position of the boosting element or elements are possible, for instance by means of continuous uniform traces.

Figure 3D:
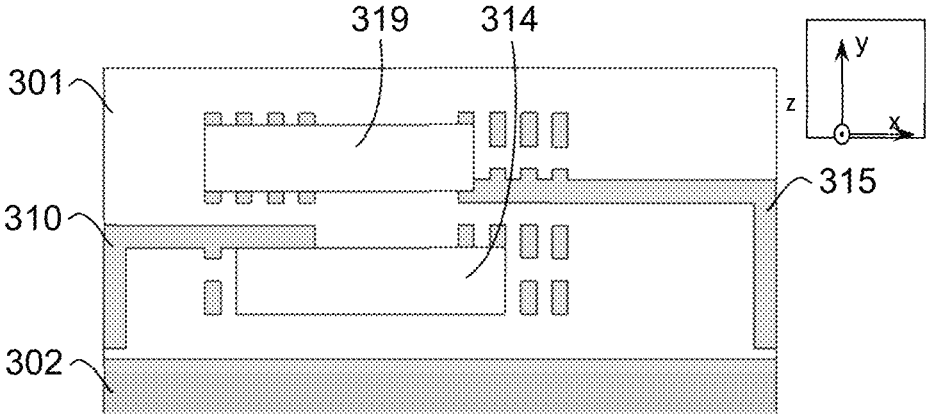

Another implementation can be the allocation of discrete series of floating pads connected to the conductive element or elements. For instance FIG. 3C exemplifies a printed circuit board including a number of floating, unconnected pads (311, 312, 316, 317) which might be used to shift and tune the position of the boosting elements. FIG. 3D shows an example of how boosting elements 314 and 319 might be mounted selectively in different positions of the floating pads. In this example, by shifting boosting element 314 to the right one or two pads one would change the electrical length of the arm 310-314, while changing the coupling characteristics between 319 and 314. This can be useful to accommodate the invention to variations on the surrounding elements of the wireless devices, for instance mechanical changes in the external enclosure, and changes in the mechanical architecture and disposition of nearby elements such as screws, posts, shields, displays microphones, etc. By including this pads in the manufacturing layouts a fine tune can be done without necessarily changing such a manufacturing layout, which results in a reduced cost and a shorter design cycle and time to market.

Figure 4A:
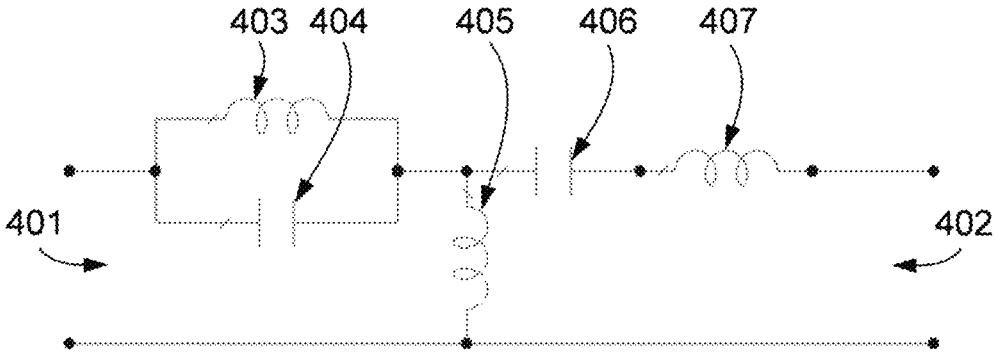
FIGS. 4A and 4B illustrate exemplary first and second matching networks of a radiofrequency system corresponding to a preferred embodiment.

In FIG. 4A there is represented an exemplary matching network that may be included in a radiofrequency system such as 112 of FIG. 1A or 1B. Said matching network comprises a first stage formed by an LC resonator (components 403 and 404) in series, a shunted inductor 405 as a second stage, a third stage comprising series capacitor 406, and a fourth stage comprising series inductor 407. Port 401, in this example, could be connected to port 113 or 114 in FIG. 1A, and port 402 could be connected to the external port of the radiating system, such as 115 in FIG. 1A or 1B. It will be readily apparent to the skilled in the art that other matching networks may be used instead, for instance some advantageous matching networks are disclosed in patent applications U.S. 62/152,991 and EP15165167 and may be used herein, since they rely on specific combination of stages that provide impedance matching in first and second frequency regions.

Figure 4B:
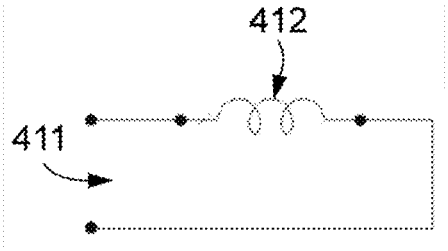

FIG. 4B shows a matching network which, in relation to the example of FIG. 4A, could be connected to the other port of the radiofrequency system, like for instance 114 or 113 in FIG. 1A, using port 411 of the matching network. It is of particular relevance that the matching network is connected to ground so that the conductive element is also connected to ground, in this particular example this is achieved through inductor 412. Other components or combinations of components could be used instead, thus the matching network is not limited to just one stage as in this example.

Figure 5A:
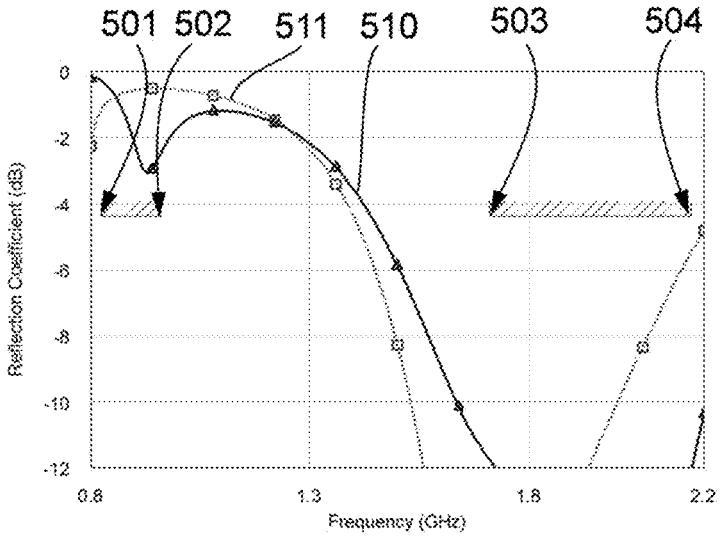
FIGS. 5A-5C shows a comparison of reflection coefficient and impedance curves at the external port of a radiating system comprising different radiofrequency systems.

FIG. 5A represents the reflection coefficient at the external port of two radiating systems comprising a radiating structure such as the one represented in FIG. 2A, when the matching network interconnected between the external port and the conductive element coupled to said external port comprises no components. In the exemplary graph, the first frequency region is delimited by lowest 501 and highest 502 frequencies (in this particular example said frequencies respectively correspond to 824 MHz and 960 MHz), and the second frequency region is delimited by lowest 503 and highest 504 frequencies (in this particular example said frequencies respectively correspond to 1710 MHz and 2170 MHz). Further, said frequency markers are shown for a threshold level of −4.4 dB; in other examples, an acceptable reflection coefficient may be set at −3 dB, or −6 dB, or other values that are appropriate for the operation of the particular communication, broadcast or wireless connectivity standards. Reflection coefficient curve 510 (solid line) corresponds to a radiating system wherein the other conductive element is directly connected to the ground plane, whereas reflection coefficient curve 511 (dashed line) corresponds to a radiating system wherein said other conductive element is connected to the ground plane using a matching network such as the one of FIG. 4B.

Curve 510 presents a reflection coefficient closer to the thresholds indicated for operation in the first and second frequency regions. In contrast, curve 511 features worse reflection coefficient with respect to curve 510 in order to provide such multiband operation. This is particularly relevant since traditionally it is considered that achieving an acceptable impedance bandwidth, especially at lower frequencies (such as the frequency range from 501 and 502) is complex, more in particular for antenna elements that are electrically short. This is also reflected in Smith chart of FIG. 5C showing the respective impedances measured at the external port in the same situation, with the solid line 540 corresponding to curve 510, and the dashed line 550 corresponding to curve 511.

For illustrative purposes, for the solid curve 540, lower and higher frequency limits in the first frequency region are indicated as 541 and 542, and lower and higher frequency limits in the second frequency region are indicated as 543 and 544. For the dashed line 550, lower and higher frequency limits in the first frequency region are indicated as 551 and 552, and lower and higher frequency limits in the second frequency region are indicated as 553 and 554.

Figure 5B:
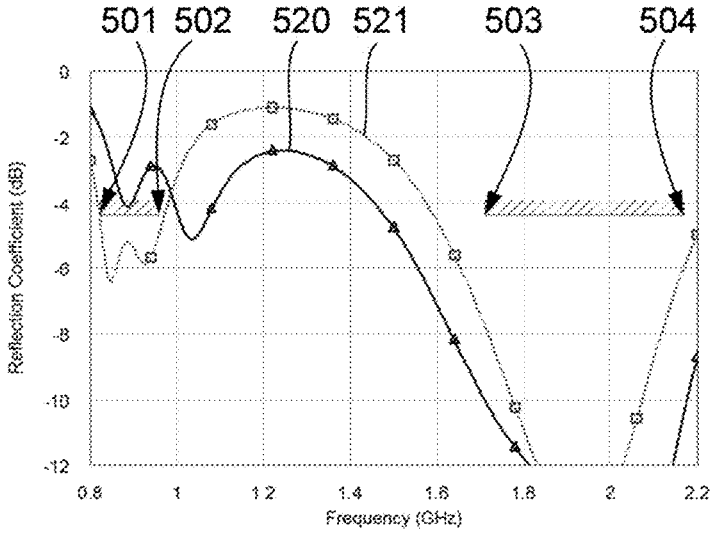
Figure 5C:
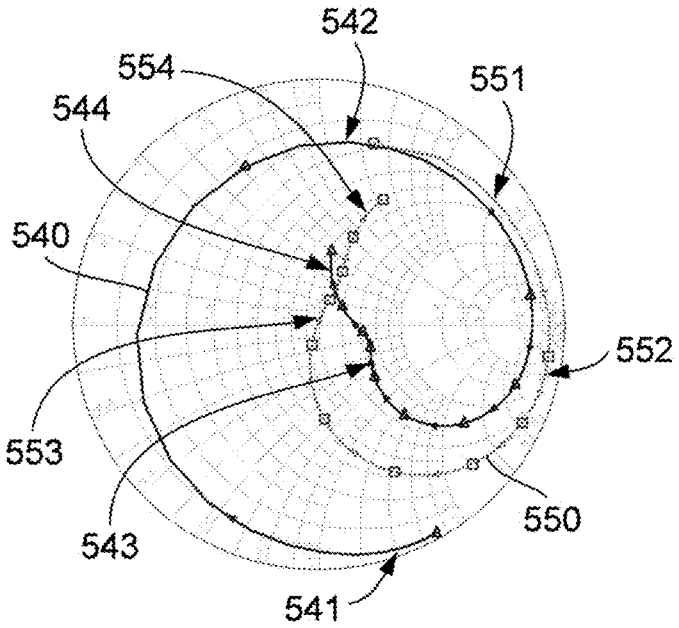

In FIG. 5B there is shown the reflection coefficient, at the external port, when the matching network that is connected to the driven conductive element and the external port comprises a circuit such as FIG. 4A (instead of not comprising any components as in FIG. 5A), and the parasitic conductive element is either directly connected to ground (corresponding to solid line 520), or connected to ground through a matching network such as FIG. 4B (corresponding to dashed line 521). Curve 521 meets the threshold limits in both frequency regions but curve 520 does not meet the threshold in the first frequency region.

Prior art references disclosing radiating structures structurally similar to the ones from the present invention may achieve multiband operation by means of radiating structures configured to feature reflection coefficient levels that are substantially close to the thresholds of each frequency region or that are already better than said thresholds. A radiating system of the present invention, instead, has the flexibility to adjust the radioelectric performance by means of the position of the boosting and conductive elements, and the radiofrequency system, featuring reflection coefficient levels like curve 511 when the matching network connected to the external port comprises no components, and with no complex geometries of the radiating structure.

In other embodiments, a reflection coefficient curve similar to 521 may be achieved when the conductive element that is connected to the ground plane is directly connected to ground as long as the resulting impedance is suitable for the use of a matching network providing impedance matching in at least first and second frequency regions.

Figure 6:
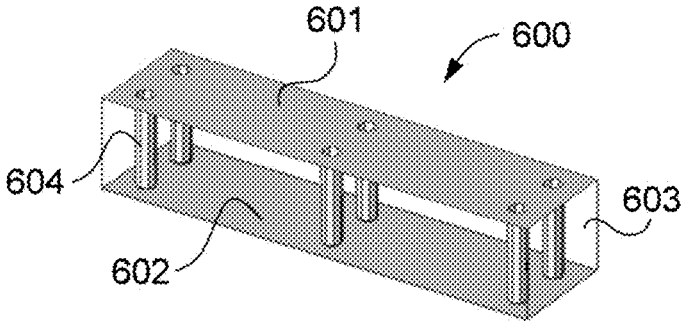
FIG. 6 shows an exemplary boosting element configured to be connected to conductive elements of a radiating structure as described herein.

An exemplary boosting element is shown in FIG. 6. The boosting element 600 comprises a first conductive surface 601, a second conductive surface 602, a dielectric element or support 603 (shown transparent for illustrative purposes only), and several via holes 604 electrically connecting the first conductive surface 601 with the second conductive surface 602. The first and second conductive surfaces 601 and 602 substantially feature rectangular shapes, but it is clear to the skilled in the art that said conductive surfaces may take the form of other shapes as well.

A connection point (such as 103 and/or 107 in FIG. 1A) of a boosting element such as 600 may be located in one of the first and second conductive surfaces 601 and 602, preferably substantially close to a corner of one of said first and second conductive surfaces.

The foregoing is merely illustrative of the principles of this invention and various modifications can be made by those skilled in the art without departing from the scope and spirit of the invention.

What is claimed is:

1. A wireless device comprising a radiating system configured to operate in one frequency region of the electromagnetic spectrum, the radiating system comprising:

a radiofrequency system comprising at least one matching network;

an external port; and a radiating structure comprising:

at least first and second conductive elements, each connected to the radiofrequency system;

at least a first boosting element electrically connected to one of the at least first and second conductive elements; and a ground plane layer, wherein:

a minimum distance between at least one point in each of the first and second conductive elements and the at least one boosting element is no greater than 3% of the free-space wavelength at the lowest frequency of operation of the radiating system;

one of the at least first and second conductive elements is connected to ground and one of the at least first and second conductive elements is connected to the external port;

a ratio between a longest side of a ground plane rectangle defined as the minimum-sized rectangle encompassing the ground plane layer and a free-space wavelength corresponding to the lowest frequency of the frequency region of operation is greater than 0.1 and less than 0.4; and the radiating system features operation in a frequency region of impedance bandwidth greater than 5%.

2. The wireless device according to claim 1, wherein the radiating system features operation in a frequency region of impedance bandwidth greater than 10%.

3. The wireless device according to claim 1, wherein the radiating system features operation in a frequency region of impedance bandwidth greater than 15%.

4. The wireless device according to claim 1, wherein the radiating system features operation in a frequency region of impedance bandwidth greater than 20%.

5. The wireless device according to claim 1, wherein the radiating structure further comprises a second boosting element also connected to one of the at least first and second conductive elements.

6. The wireless device according to claim 1, wherein the conductive element connected to ground is connected through a matching network comprising at least one component.

7. The wireless device according to claim 6, wherein the conductive element connected to ground is connected through an inductor.

8. The wireless device according to claim 1, wherein the ratio between a longest side of a ground plane rectangle defined as a minimum-sized rectangle encompassing the ground plane layer and a free-space wavelength corresponding to a lowest frequency of the frequency region of operation is greater than 0.1 and less than 0.3.

9. The wireless device according to claim 1, wherein the ratio between a longest side of a ground plane rectangle defined as a minimum-sized rectangle encompassing the ground plane layer and a free-space wavelength corresponding to a lowest frequency of the frequency region of operation is greater than 0.1 and less than 0.25.

10. The wireless device according to claim 1, wherein the ratio between a longest side of a ground plane rectangle defined as a minimum-sized rectangle encompassing the ground plane layer and a free-space wavelength corresponding to a lowest frequency of the frequency region of operation is greater than 0.1 and less than 0.2.

11. The wireless device according to claim 1, wherein a minimum distance between at least one point in the first conductive element and at least one point in the second conductive element is no greater than 3% of the free-space wavelength at a lowest frequency of operation of the radiating system.

12. The wireless device according to claim 1, wherein a minimum distance between at least one point in the first conductive element with no boosting element connected to it and at least one point in a boosting element connected to the second conductive element is no greater than 3% of the free-space wavelength at a lowest frequency of operation of the radiating system.

13. The wireless device according to claim 1, wherein a minimum distance between at least one point in a first boosting element connected to the first conductive element and at least one point in a second boosting element connected to the second conductive element is no greater than 3% of the free-space wavelength at a lowest frequency of operation of the radiating system.

14. The wireless device according to claim 1, wherein a minimum distance between the first and second conductive elements is less than 2% of the free-space wavelength at a lowest frequency of operation of the radiating system.

15. The wireless device according to claim 1, wherein a minimum distance between the first and second conductive elements is less than 1% of the free-space wavelength at a lowest frequency of operation of the radiating system.

* * * * *